US008076864B2

(12) United States Patent
Rudolph

(10) Patent No.: US 8,076,864 B2
(45) Date of Patent: Dec. 13, 2011

(54) CIRCUIT CONFIGURATION FOR STARTING AND OPERATING AT LEAST ONE DISCHARGE LAMP

(75) Inventor: Bernd Rudolph, Forstern (DE)

(73) Assignee: OSRAM AG, Munich (DE)

( * ) Notice: Subject to any disclaimer, the term of this patent is extended or adjusted under 35 U.S.C. 154(b) by 232 days.

(21) Appl. No.: 12/532,156

(22) PCT Filed: Apr. 23, 2007

(86) PCT No.: PCT/EP2007/053945

§ 371 (c)(1),
(2), (4) Date: Sep. 20, 2009

(87) PCT Pub. No.: WO2008/128574

PCT Pub. Date: Oct. 30, 2008

(65) Prior Publication Data

US 2010/0033104 A1 Feb. 11, 2010

(51) Int. Cl.
*H05B 41/26* (2006.01)

(52) U.S. Cl. ..... 315/276; 315/225; 315/244; 315/312; 315/DIG. 5; 315/DIG. 7

(58) Field of Classification Search ..... 315/119, 315/209 R, 224, 225, 226, 244, 276, 291, 315/307, 312, DIG. 5, DIG. 7
See application file for complete search history.

(56) References Cited

U.S. PATENT DOCUMENTS

| | | | | |
|---|---|---|---|---|
| 4,525,648 | A * | 6/1985 | De Bijl et al. | 315/224 |
| 4,684,851 | A * | 8/1987 | Van Meurs | 315/224 |
| 4,712,045 | A * | 12/1987 | Van Meurs | 315/224 |
| 5,469,028 | A * | 11/1995 | Nilssen | 315/291 |
| 5,929,573 | A * | 7/1999 | Louwers et al. | 315/219 |
| 6,259,213 | B1 * | 7/2001 | Rudolph | 315/209 R |
| 6,577,077 | B2 * | 6/2003 | Hu et al. | 315/291 |

FOREIGN PATENT DOCUMENTS

| | | |
|---|---|---|
| EP | 0093469 B1 | 1/1987 |
| EP | 0189221 B1 | 11/1989 |
| EP | 0171108 B1 | 2/1990 |
| WO | 0024233 A2 | 4/2000 |

OTHER PUBLICATIONS

International Search Report of PCT/EP2007/053945 mailed Sep. 4, 2007.

* cited by examiner

*Primary Examiner* — Douglas W Owens
*Assistant Examiner* — Thai Pham

(57) ABSTRACT

A circuit arrangement for starting and operating at least one discharge lamp is provided.

6 Claims, 1 Drawing Sheet

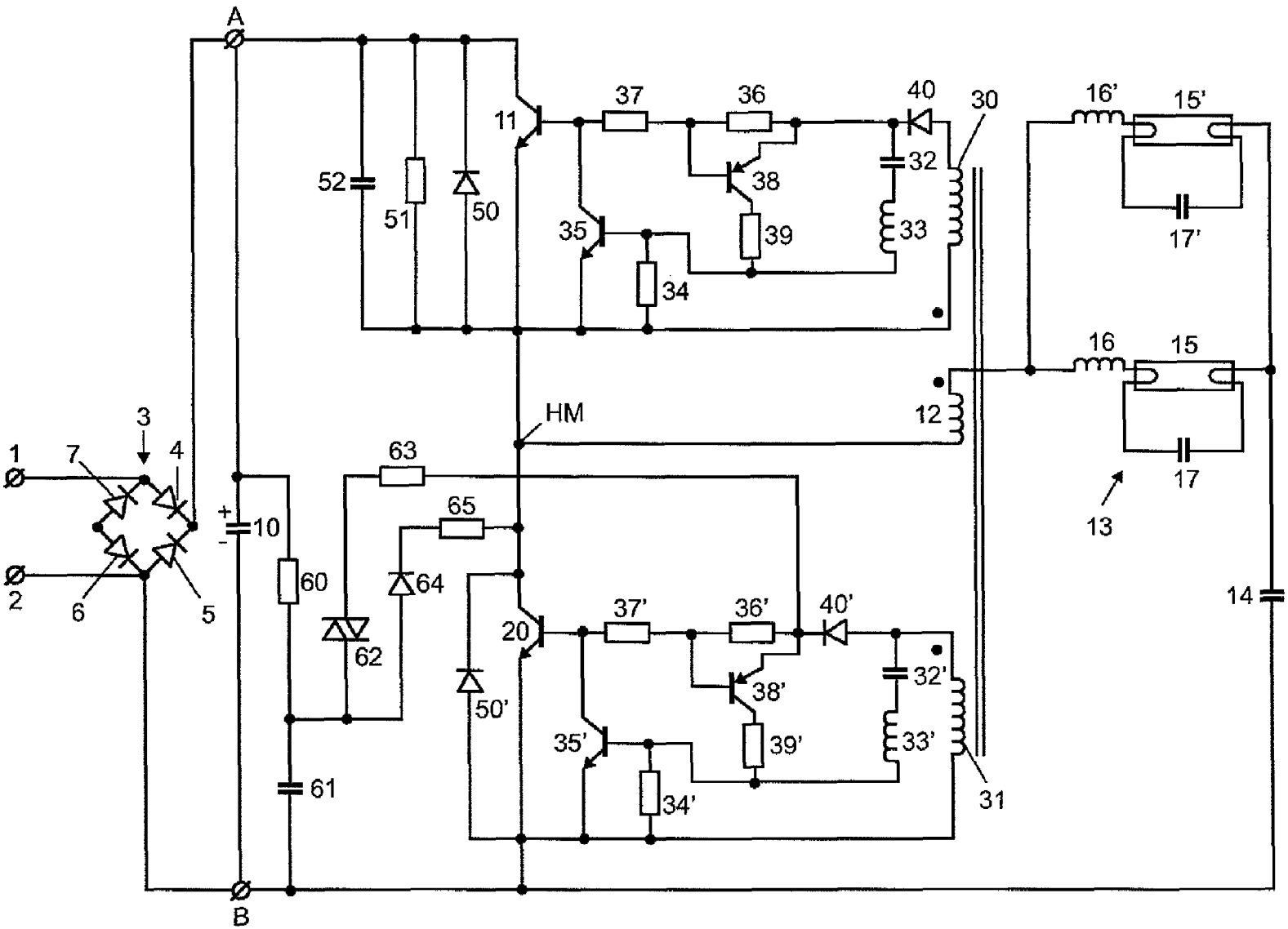
14
15'
17'
15
17
16'
16
13
30
31
40
32
33
12
32'
33'
40'
36
38
39
36'
38'
39'
34
34'
37
37'
35
35'
HM
11
20
50
50'
51
65
64
63
62
52
60
61
10
A
B
5
4
3
7
6
1
2

CIRCUIT CONFIGURATION FOR STARTING AND OPERATING AT LEAST ONE DISCHARGE LAMP

RELATED APPLICATIONS

The present application is a national stage entry according to 35 U.S.C. §371 of PCT application No.: PCT/EP2007/053945 filed on Apr. 23, 2007.

BACKGROUND

The present invention relates to a circuit arrangement for starting and operating at least one discharge lamp with a first input terminal and a second input terminal for connecting a supply voltage, an inverter, which includes at least one first main transistor and one second main transistor in a half-bridge arrangement, which main transistors are coupled in series between the first input terminal and the second input terminal, a first output terminal and a second output terminal for connecting the at least one discharge lamp, at least one lamp inductor, which is coupled in series with the first output terminal, at least one capacitor, which is coupled in parallel with the first output terminal and the second output terminal, a transformer with a primary winding and a first secondary winding and a second secondary winding, a series circuit including the primary winding and the at least one lamp inductor being coupled between the half-bridge center point and a reference potential, and a first control circuit for driving the first main transistor and a second control circuit for driving the second main transistor, each control circuit having an input and an output, the output of the first control circuit being coupled to the control electrode of the first main transistor, and the output of the second control circuit being coupled to the control electrode of the second main transistor, with the input of the first control circuit being coupled to the first secondary winding and the input of the second control circuit being coupled to the second secondary winding, each control circuit having a timing circuit, whose time constant varies as a function of the voltage across the input of the respective control circuit, each timing circuit having at least one first auxiliary transistor, the working electrode of the first auxiliary transistor being coupled to the control electrode of the associated main transistor and the reference electrode of the first auxiliary transistor being coupled to a reference potential, the control electrode of the first auxiliary transistor being coupled to the center point of a frequency-dependent voltage divider, which is coupled firstly to the respective secondary winding and secondly to the respective reference potential.

Such a circuit arrangement is known from EP 0 093 469 A1. In this case, the frequency-dependent voltage divider of each timing circuit includes a nonreactive resistor and a capacitor, the voltage drop across the capacitor being coupled to the control path of the first auxiliary transistor. Furthermore, zener diodes are provided which are used as relatively precise thresholds for the generation of the open-circuit voltage for the discharge lamp, i.e. the voltage which is available across the lamp for starting.

One disadvantage with the solution in accordance with the mentioned document is the considerable control losses, since precise zener diodes with a low dynamic resistance, as are required for this solution, are only available above approximately 7 V, and the voltage generated via a current-measuring resistor during lamp operation is of this order of magnitude. More detailed consideration of the mentioned solution shows that a reduction in the value of the nonreactive resistor of the frequency-dependent voltage divider needs to be compensated for by enlarging the capacitor of the frequency-dependent voltage divider. Since the dynamic resistance of a zener diode increases with a lower zener diode voltage, as would be required when decreasing the voltage across the secondary winding in order to reduce the control losses, this results in a higher time constant. The delay of the voltage across the control electrode of the first auxiliary transistor in comparison with the current into the control electrode of the main transistor is thus undefined. This also results in a large, undesired spread. A reduction in the voltage drop across the respective secondary winding in order to decrease the control losses thus results in an increase in the tolerances.

The current-limiting effect of the lamp inductor is reduced as a result of saturation which may occur, as a result of which the main transistors of the inverter can be destroyed. It should be taken into consideration here that operation of the lamp inductor with slight saturation is desirable, however, since this results in low losses. It is precisely at this point that an increase in the tolerances becomes noticeable as a negative factor since, as a result, the risk of saturation of the lamp inductor arises. As a result, a reduction in the control losses would in this way result in the component parts of the circuit arrangement being provided with increased dimensions and therefore in increased costs.

SUMMARY

Various embodiments develop the circuit arrangement mentioned at the outset in such a way that a reduction in the control losses is made possible without the risk of destruction of the main transistors of the inverter and/or without the need to increase the dimensions of the main transistors of the inverter.

Various embodiments are based on the knowledge that one disadvantage of the prior art consists in the fact that the capacitor of the frequency-dependent voltage divider is therefore also problematic since it acts as an energy store at the control electrode of the first auxiliary transistor and there is thus an undesirable delay in the voltage across the control electrode of the first auxiliary transistor in comparison with the current into the control electrode of the main transistor as a result of the charging and discharging of said energy store. On the basis of this knowledge, the frequency-dependent voltage divider is implemented in a circuit arrangement according to various embodiments by an inductance and a nonreactive resistor, the voltage drop across the nonreactive resistor being coupled to the control path of the first auxiliary transistor. As a result of this measure, the control electrode of the first auxiliary transistor is no longer coupled in an undesirable manner to an energy store, and undesirable delays are thus eliminated. As a second measure, the zener diodes which are associated with the disadvantages which have already been mentioned above are replaced by virtue of a second auxiliary transistor being connected in parallel with the inductance of the frequency-dependent voltage divider, the second auxiliary transistor including a drive circuit, which is designed to bridge the associated inductance as a function of the voltage across the associated secondary winding by virtue of the second auxiliary transistor. It should be taken into consideration here that transistors which are used for the second auxiliary transistor generally switch at a voltage of 0.6 to 0.7 V across the control path, i.e. in the case of such a voltage between the control electrode and the reference electrode, whereas the zener diode voltages already mentioned above are above this by a factor of 10.

As a result of the configuration according to various embodiments, it is possible using a few very inexpensive standard component parts to ensure good reproducibility of the open-circuit voltage and the operational parameters, i.e. the parameters for the continuous operation of the discharge lamp, with at the same time markedly reduced control losses. In an exemplary embodiment which has been implemented, the control losses could be reduced by approximately 80%.

A preferred embodiment is characterized by the fact that the second mentioned measure according to the invention, i.e. the measure which provides a second auxiliary transistor which is connected in parallel with the associated inductance, is provided only in one of the two timing circuits. This is possible in particular in the case of load circuits with low operational efficiency in which the difference between the starting frequency and the operating frequency is small and in which the lamp inductor is operated with only a low level of saturation during starting.

In a preferred embodiment, the at least one second auxiliary transistor has a control electrode, a working electrode and a reference electrode, the working electrode being coupled to that point of the associated voltage divider at which the inductance is coupled to the nonreactive resistor, the reference electrode being coupled to the associated second secondary winding. This circuitry ensures, in a simple manner, that the inductance of the frequency-dependent voltage divider can be bridged by virtue of the second auxiliary transistor if the second auxiliary transistor is switched into the on state.

It is furthermore preferred that the at least one timing circuit furthermore includes a current-measuring resistor, which is coupled in series between the associated secondary winding and the output of the associated timing circuit, the voltage drop across the current-measuring resistor being coupled to the control electrode of the associated second auxiliary transistor. As a result, the voltage which switches the second auxiliary transistor on and off is made dependent on the current into the control electrode of the respective main transistor. It is thus possible to achieve a situation in which bridging of the inductance of the frequency-dependent voltage divider is linked very precisely with the time profile of the current into the control electrode of the respective main transistor, which in turn is an image of the load circuit current owing to the design of the transformer as a current transformer. Undesired temporal tolerances as in the prior art, which could inadvertently bring about saturation of the lamp inductor, are thus reliably ruled out.

Preferably, it is furthermore provided that a further nonreactive resistor is coupled between the working electrode of the at least one second auxiliary transistor and that point of the associated voltage divider at which the inductance is coupled to the nonreactive resistor. A nonreactive resistor provided at this point acts as a current-limiting resistor and thus ensures that the current driven by the transformer continues to flow substantially through the current-measuring resistor and thus keeps the second auxiliary transistor safely turned on.

Preferably, it is furthermore provided that a capacitor is coupled between the point at which the inductance of the respective voltage divider is coupled to the respective secondary winding and the respective inductance. This measure reliably prevents saturation of the inductance of the frequency-dependent voltage divider for the case in which the voltage which is fed into the control circuit from the associated secondary winding has a DC component. In this case, care should be taken that the capacitor is selected to have a sufficiently high value that the time constant fixed by the nonreactive resistor and the inductance of the frequency-dependent voltage divider remains unchanged.

Finally, it is furthermore preferred that a further nonreactive resistor is coupled between the current-measuring resistor and the output of the associated timing circuit. As a result of this measure, there is again a sufficient voltage drop across the two resistors during lamp operation for the base-emitter forward voltage of the first auxiliary transistor to be safely reached at the resistor of the frequency-dependent voltage divider as well as for the feedback to be sufficient.

BRIEF DESCRIPTION OF THE DRAWING(S)

An exemplary embodiment of a circuit arrangement according to the invention will now be described in more detail below with reference to the attached drawing, which shows a schematic illustration of an exemplary embodiment of a circuit arrangement according to the invention.

DETAILED DESCRIPTION

The following detailed description refers to the accompanying drawings that show, by way of illustration, specific details and embodiments in which the invention may be practiced.

The FIGURE shows a circuit arrangement according to the invention and a supply arrangement for this circuit arrangement and two lamps, which are started with the aid of this circuit arrangement and fed, respectively. The supply arrangement includes two input terminals 1 and 2, which are intended for connection to an AC voltage source. A rectifier bridge 3 with four diodes (4 to 7, inclusive) is connected to these terminals 1 and 2. It is furthermore possible for a filter, for example, to be provided between the input terminals 1 and 2, on one side, and the rectifier bridge 3, on the other side. An output terminal of the rectifier bridge 3 is connected to a first input terminal A of the circuit arrangement. A second output terminal of the rectifier bridge 3 is connected to an input terminal B of the circuit arrangement.

This circuit arrangement will now be described. The terminals A and B are connected to one another by a capacitor 10 and also by a series circuit including a first main transistor 11, a primary winding 12 of a current transformer and a load circuit 13, details of which will be given below, as well as a capacitor 14. The load circuit 13 includes two substantially identical parallel branches. Each of these branches includes a discharge lamp 15 and 15', connected in series with a lamp inductor 16 and 16', respectively. Each of the lamps 15, 15' has two preheatable electrodes. The electrode ends which belong to a lamp 15, 15' and are positioned at a distance from a supply source are connected to one another by a capacitor 17 and 17', respectively. Each of these capacitors 17, 17' therefore represents a circuit element which is connected in parallel with the relevant lamp 15, 15'.

The series circuit including the primary winding 12 of the transformer, the load circuit 13 and the capacitor 14 is connected in parallel with a second main transistor 20. Each of the two main transistors 11 and 20 is of the NPN type. In the circuit, the collector of the main transistor 11 is connected to the positive input terminal A of the circuit arrangement. The emitter of this main transistor 11 is connected to the collector of the main transistor 20. The emitter of this main transistor 20 is connected to the negative input terminal B of the circuit arrangement. Optionally, current negative feedback resistors, in particular emitter resistors, can be provided for the main transistors 11 and 20. The main transistors 11 and 20 in a half-bridge arrangement define a half-bridge center point HM. The current transformer with the primary winding 12 has two secondary windings 30 and 31. The secondary winding 30 is connected to a control circuit of the main transistor 11. The secondary winding 31 is connected to a control circuit of the main transistor 20. The control circuits are substantially identical to one another.

The ends of the secondary winding 30 are connected to one another via a diode 40 and a timing circuit, which includes a series circuit including a capacitor 32, an inductance 33 and a nonreactive resistor 34. The timing circuit furthermore includes a first auxiliary transistor 35, whose base is connected to the node between the capacitor 32 and the inductance 33 on one side and the nonreactive resistor 34 on the other side. Furthermore, a second auxiliary transistor 38 is provided, whose collector-emitter path together with a nonreactive resistor 39 is connected in parallel with the series circuit including the capacitor 32 and the inductance 33, which resistor 39 is arranged in series with said second auxiliary transistor. A nonreactive resistor 36, which acts as a current-measuring resistor, is connected between the base and the emitter of the second auxiliary transistor 38. A further nonreactive resistor 37 is connected in series between the nonreactive resistor 36 and the base of the main transistor 11.

A corresponding timing circuit 32' to 40' connects the ends of the secondary winding 31 to one another. A diode 50 is connected back-to-back in parallel with the main transistor 11. A diode 50' is connected back-to-back in parallel with the main transistor 20. Furthermore, a nonreactive resistor 51 and a capacitor 52 are connected in parallel with the main transistor 11.

Finally, a circuit for starting the circuit arrangement is provided. This circuit includes, inter alia, a series circuit including a resistor 60 and a capacitor 61, which is connected in parallel with the capacitor 10. A node between the resistor 60 and the capacitor 61 is connected to a bidirectional threshold value element 62, in this case a DIAC. The other side of this threshold value element 62 is connected to a point between the resistor 36' and the diode 40' of the control circuit of the main transistor 20 via a resistor 63. The node between the resistor 60 and the capacitor 61 is also connected to a diode 64. The other side of this diode 64 is connected to the collector of the main transistor 20 via a resistor 65.

The described circuit functions as follows: the terminals 1 and 2 are connected to an AC voltage of 230 V, 50 Hz, for example. As a result, a DC voltage is applied by the rectifier bridge 3 between the terminals A and B of the circuit arrangement. As a result, current first flows from A through the resistor 51, the primary winding 12 of the current transformer, the load circuit 13 and the capacitor 14 to the terminal B, which results in the capacitors 17, 17' and 14 being charged. Furthermore, the capacitor 61 is charged via the resistor 60. If the threshold voltage of the threshold value element 62 is then reached, the capacitor 61 is discharged, inter alia via the resistors 63, 36', 37' and the base-emitter junction of the main transistor 20. This discharge operation ensures that the main transistor 20 is switched to the on state for the first time. As a result, the capacitor 14 in the circuit 14, 13, 12, 20, 14 is discharged. Since this discharge current also flows through the primary winding 12 of the current transformer, voltages are induced in the two secondary windings 30 and 31. The induced voltage in the winding 31 has a directional sense which keeps the main transistor 20 in the on state. The elements 32', 33', 34' of the timing circuit switch the first auxiliary transistor 35' into the on state once a predetermined period of time has elapsed. As a result, the main transistor 20 is switched to the off state. The current of the load circuit 13 then flows through the combination of the diode 50 and the capacitor 52 and through the capacitor 10 back to the capacitor 14. The actual value of this current decreases and, as it approaches its zero crossing, the main transistor 11 is switched into the on state by the winding 30, the diode 40 and the resistors 36 and 37. In the same way as described for the switching operation of the main transistor 20, the transistor 11 is then switched back to the off state after a while. The circuit arrangement is now in operation. The main transistors 11 and 20 are switched into the on state alternately. The circuit 64, 65 then ensures that the starting capacitor 61 is no longer charged up to the breakdown voltage of the threshold value element 62.

The lamps 15, 15' are then not yet started. The load circuit 13 in this case comprises a parallel circuit including two virtually identical branches, each of which includes a series circuit including a lamp inductor 16 and a capacitor 17 (or 16' and 17'). This circuit is not yet damped by the lamps 15, 15'. Without the presence of the second auxiliary transistors 38 and 38' in the timing circuits, the frequency of the current flowing through the load circuit 13 would be set virtually to the resonant frequency of this circuit. As a result, voltages would be present across the lamps 15 and 15' which are so high that said lamps would start with cold cathodes. In the case of defective lamps, this could also result in an electrically impermissible situation possibly arising in the circuit 13 as a result of very high currents.

If the currents in the primary winding 12 of the transformer increase, however, a current is now induced in the secondary windings 30 and 31 which results in a voltage drop across the respective current-measuring resistor 36, 36', which voltage drop is sufficient for switching the associated second auxiliary transistor 38, 38' into the on state. Thus, the time constant of the timing circuit is influenced, in this case as a result of the fact that the series circuit including the capacitor 32 and the inductance 33 or 32' and 33' is bridged by the nonreactive resistor 39. As a result, the voltage across the nonreactive resistor 34 or 34' reaches the value at which the auxiliary transistor 35 or 35' is switched into the on state more quickly, which results in the associated main transistor 11 or 20 being switched into the off state more quickly. This results in the frequency of the circuit arrangement reaching a higher value. This higher frequency results in a higher voltage across the lamp inductor 16 or 16' and therefore in a lower voltage across the lamp 15 or 15'. Thus, the lamps have the tendency to preheat their electrodes by virtue of the capacitor 17 or 17'. As a result, there is no risk of the lamps starting with excessively cold electrodes. Only when the electrodes have been preheated to a sufficient extent is the voltage present across the lamps sufficient for starting said lamps. The current flowing through the load circuit and therefore the primary winding 12 of the current transformer then no longer needs to assume a high value since the damping of the lamps 15 and 15' is now achieved. This results in the current flowing through the windings 30 and 31 being comparatively low, with the result that, as a result of the voltage drop across the current-measuring resistor 36 or 36', the switching threshold of the second auxiliary transistor 38 or 38' is no longer reached. This means that a longer period of time elapses before a voltage is present across the input of the first auxiliary transistor 35 or 35' which switches this transistor on. In turn this results in the associated main transistor 11 or 20 being switched into the on state at a later point in time. This means that the frequency at which the circuit arrangement then operates is lower than that during the starting operation of the lamps 15 and 15'.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit arrangement for starting and operating at least one discharge lamp, the circuit arrangement comprising:

a first input terminal and a second input terminal for connecting a supply voltage;

an inverter, which comprises at least one first main transistor and one second main transistor in a half-bridge arrangement, which main transistors are coupled in series between the first input terminal and the second input terminal;

a first output terminal and a second output terminal for connecting the at least one discharge lamp;

at least one lamp inductor, which is coupled in series with the first output terminal;

at least one capacitor, which is coupled in parallel with the first output terminal and the second output terminal;

a transformer with a primary winding and a first secondary winding and a second secondary winding, a series circuit comprising the primary winding and the at least one lamp inductor being coupled between the half-bridge center point and a reference potential; and a first control circuit for driving the first main transistor and a second control circuit for driving the second main transistor, each control circuit having an input and an output, the output of the first control circuit being coupled to the control electrode of the first main transistor, and the output of the second control circuit being coupled to the control electrode of the second main transistor, with the input of the first control circuit being coupled to the first secondary winding and the input of the second control circuit being coupled to the second secondary winding, each control circuit having a timing circuit, whose time constant varies as a function of the voltage across the input of the respective control circuit, each timing circuit having at least one first auxiliary transistor, the working electrode of the first auxiliary transistor being coupled to the control electrode of the associated main transistor and the reference electrode of the first auxiliary transistor being coupled to a reference potential, the control electrode of the first auxiliary transistor being coupled to the center point of a frequency-dependent voltage divider, which is coupled firstly to the respective secondary winding and secondly to the respective reference potential; wherein the frequency-dependent voltage divider of each timing circuit comprises at least one inductance and a nonreactive resistor, the voltage drop across the nonreactive resistor being coupled to the control path of the first auxiliary transistor; at least one timing circuit comprising a second auxiliary transistor, which is connected in parallel with the associated inductance, the second auxiliary transistor comprising a drive circuit, which is designed to bridge the associated inductance as a function of the voltage across the associated secondary winding by virtue of the second auxiliary transistor.

2. The circuit arrangement as claimed in claim 1, wherein the at least one second auxiliary transistor has a control electrode, a working electrode and a reference electrode, the working electrode being coupled to that point of the associated voltage divider at which the inductance is coupled to the nonreactive resistor, the reference electrode being coupled to the associated second secondary winding.

3. The circuit arrangement as claimed in claim 1, wherein the at least one timing circuit furthermore comprises a current-measuring resistor, which is coupled in series between the associated secondary winding and the output of the associated timing circuit, the voltage drop across the current-measuring resistor being coupled to the control electrode of the associated second auxiliary transistor.

4. The circuit arrangement as claimed in claim 1, wherein a further nonreactive resistor is coupled between the working electrode of the at least one second auxiliary transistor and that point of the associated voltage divider at which the inductance is coupled to the nonreactive resistor.

5. The circuit arrangement as claimed in claim 1, wherein a capacitor is coupled between the point at which the inductance of the respective voltage divider is coupled to the respective secondary winding and the respective inductance.

6. The circuit arrangement as claimed in claim 1, wherein a further nonreactive resistor is coupled between the current-measuring resistor and the output of the associated timing circuit.

* * * * *